US006831607B2

(12) United States Patent
Hebron et al.

(10) Patent No.: US 6,831,607 B2
(45) Date of Patent: Dec. 14, 2004

(54) SINGLE-FEED, MULTI-BAND, VIRTUAL TWO-ANTENNA ASSEMBLY HAVING THE RADIATING ELEMENT OF ONE PLANAR INVERTED-F ANTENNA (PIFA) CONTAINED WITHIN THE RADIATING ELEMENT OF ANOTHER PIFA

(75) Inventors: Theodore Samuel Hebron, Lincoln, NE (US); Govind Rangaswamy Kadambi, Lincoln, NE (US); Sripathi Yarasi, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 142 days.

(21) Appl. No.: 10/248,543

(22) Filed: Jan. 28, 2003

(65) Prior Publication Data

US 2004/0145521 A1 Jul. 29, 2004

(51) Int. Cl.[7] ..... H01Q 1/24
(52) U.S. Cl. ..... 343/700 MS; 343/702
(58) Field of Search ..... 343/700 MS, 702, 343/846, 853, 893

(56) References Cited

U.S. PATENT DOCUMENTS 5,550,554 A * 8/1996 Erkocevic ..... 343/828
6,295,030 B1 * 9/2001 Kozakai et al. ..... 343/700 MS
6,476,769 B1 * 11/2002 Lehtola ..... 343/702
6,573,869 B2 * 6/2003 Moore ..... 343/702
6,639,560 B1 * 10/2003 Kadambi et al. .... 343/700 MS
6,670,923 B1 * 12/2003 Kadambi et al. .... 343/700 MS
6,741,214 B1 * 5/2004 Kadambi et al. .... 343/700 MS
6,768,462 B2 * 7/2004 Umehara et al. .... 343/700 MS

* cited by examiner

*Primary Examiner*—Shih-Chao Chen
(74) *Attorney, Agent, or Firm*—Holland & Hart LLP

(57) ABSTRACT

A unitary assembly provides two virtual planar inverted-F antennas (PIFAs) within a physical volume that is occupied by one of the PIFAs. The virtual two-antenna assembly includes a single RF feed, and provides multiple frequency response in the AMPS, PCS, GSM, DCS and GPS frequency bands. A composite radiating element is supported above a ground plane. A C-shaped slot divides the composite radiating element into an outer radiating element and an inner radiating element. Two metal stubs within a slot-discontinuity of the C-shaped slot physically and electrically connect the outer radiating element to the inner radiating element. An RF feed post connects to the outer radiating element, and both of the inner and outer radiating elements are shorted to the ground plane. One metal stub provides virtual RF feed to the inner radiating element, the other metal stub provides a matching and/or tuning function to the inner radiating element, and the two metal stubs provide a matching and/or tuning function to the outer radiating element. The outer radiating element includes an L-shaped slot, and the inner radiating element includes a linear slot. Reactive loading plates extend from the composite radiating element toward the ground plane.

50 Claims, 3 Drawing Sheets

SINGLE-FEED, MULTI-BAND, VIRTUAL TWO-ANTENNA ASSEMBLY HAVING THE RADIATING ELEMENT OF ONE PLANAR INVERTED-F ANTENNA (PIFA) CONTAINED WITHIN THE RADIATING ELEMENT OF ANOTHER PIFA

RELATED PATENT APPLICATIONS

U.S. non-provisional patent application Ser. No. 10/201,859, filed Jul. 24, 2002, entitled DUAL FEED MULTI BAND PLANAR ANTENNA. U.S. non-provisional patent application Ser. No. 10/288,965, filed Nov. 6, 2002, entitled PLANAR INVERTED-F ANTENNA (PIFA) HAVING A SLOTTED RADIATING, ELEMENT PROVIDING GLOBAL CELLULAR AND GPS-BLUE TOOTH FREQUENCY RESPONSE.

FIELD OF THE INVENTION

This invention relates to the field of wireless communication, and more specifically to the construction of planar inverted-F antennas (PIFAs) for use in wireless communication devices such as mobile telephone handsets.

BACKGROUND OF THE INVENTION

The Advanced Mobile Phone Service (AMPS) and the Personal Communication Service (PCS) frequency bands, and the Global System for Mobile Communications (GSM) and the Digital Cellular System (DCS) frequency bands, form the basic dual cellular frequency bands within the US and within Europe, respectively.

There is a demand for wireless communication devices that will accommodate both the US AMPS/PCS frequency bands and the European GSM/DCS frequency bands within a single wireless communications device, so that a single wireless communications device, such as a cellular handset, can be used worldwide. This evolution toward a single cellular handset having global utility results in a need for cellular antennas that will simultaneously cover the AMPS/PCS/GSM/DCS frequency bands.

In addition, use of an antenna that is buried within, or is internal to, a cellular handset is desirable. Among the choices for an internal antenna for use within cellular handsets, a PIFA is very versatile in terms of its physical size and its performance.

In the past, multi-band PIFAs (for example two band or three band) have been provided having two or more RF feeds. However multi-feed PIFAs encounter disadvantages such as increased cost and increased mutual coupling that results from poor isolation.

Extension of a multi-feed multi-band PIFA in order to provide a global cellular PIFA (i.e. a PIFA that covers the AMPS/PCS/GSM/DCS frequency bands), cannot easily be accomplished due to the fact that the lower cellular frequency bands AMPS and GSM are close to each other, and in fact they have a region of frequency overlap, and the same is true for the upper frequency cellular bands DCS and PCS. Due to this close frequency proximity of the relevant frequency bands, as well as the region of frequency overlap, the use of two PIFAs that operate separately in the AMPS/PCS frequency bands and the GSM/DCS frequency bands can be provided within a cellular handset. But this two-PIFA assembly requires that the two antennas occupy about twice the physical volume within a cellular handset that a single PIFA would require. In addition, partitioning the physical antenna-volume that is normally available within a practical and realistic cellular handset does not usually provide a desired separate resonance in both the AMPS frequency band and the GSM frequency band. Even if one were to succeed using such a two-PIFA design, providing adequate isolation between the two PIFAs is difficult. In view of these practical design constraints, the use of two PIFAs, having two feeds and having multiple frequency bands, is not a logical choice for the realization of a global cellular PIFA construction and arrangement.

Progress has been made in the cellular technology to provide a single-feed two-band PIFA. There also has been progress in the bandwidth enhancement of single feed two-band and three-band PIFAs.

Prior art PIFAs include a radiating/receiving element (hereinafter called a radiating element) having a length and a width that is optimized to approximate a quarter-wavelength within its semi perimeter. In order to reduce the resonant frequency of the PIFA without increasing its physical size, slots of different shapes have been used within the PIFA's radiating element. With the judicious choice of a slot configuration, and by optimizing the position of the radiating element's shorting post, PIFA designs have emerged for single-feed multi-band operation.

In prior art single-feed multi-band PIFAs, the multi-band operation is the result of a combination of the quasi physical partitioning of a single band PIFA's radiating element, wherein the radiating element is a derivative of a corresponding single-feed, single-band, PIFA.

In prior art dual-feed multi-band PIFAs having two radiating elements, the two radiating elements are physically isolated from each other.

In multi purpose cellular handsets that are usable in both cellular and non-cellular applications, a multi-band antenna that simultaneously operates in both the cellular and the GPS/Bluetooth frequency bands is of interest, wherein Bluetooth (BT) is a code name for a proposed open specification to standardize data synchronization between disparate PC and handheld PC devices. Single-band PIFAs have proven to be useful in meeting the demand of GPS/BT applications.

In prior art designs, an internal GPS band antenna has been used along with a dual-band cellular antenna, to thereby provide a dual-feed, three-band, two-antenna assembly. Such dual-feed three-band two-antenna assemblies have to encounter design complexities in order to ensure adequate isolation between the two feed ports that support the two cellular frequencies and the GPS frequencies.

Conventionally, a single-feed dual-band PIFA requires only one shorting post. In the prior art, slots of different shapes have been used in the radiating element of a PIFA, mainly to lower the resonant frequency of the radiating element without increasing the physical size of the PIFA. Although attempts have been made to provide a three-band PIFA by improving the bandwidth of a two-band PIFA, little or no success has been achieved relative to providing a single-feed four-band PIFA, or in providing for a simultaneous non-cellular band (GPS/ISM) resonance within the same four-band PIFA.

In certain PIFA designs, parasitic elements have been used in a dual-band PIFA to generate an additional resonance for non-cellular application.

In order to meet the demand of a global cellular antenna, U.S. Pat. No. 6,255,994, provides for the multiple resonance of a PIFA by providing frequency-selecting switches for different resonant frequencies, so that the same telephone and antenna can be used globally. However, such a design results in an increased cost and additional complexities due to the increased number of electrical connections/components that are required for the antenna. In addition, and apart from the higher cost, the possibility exists for a gain degradation of the antenna when additional electrical components are introduced into the antenna.

SUMMARY OF THE INVENTION

This invention provides a single-feed four-band virtual two-PIFA assembly (hereinafter more conveniently called a two-PIFA assembly) that is responsive to the AMPS, PCS, GSM and DCS frequency bands, wherein this multi-band operation is realized by inserting the metal radiating element of one PIFA (i.e. an inner radiating element) within the metal radiating element of another PIFA (i.e. an outer radiating element).

A generally C-shaped slot separates the metal inner radiating element from the metal outer radiating element, and two spaced-apart metal stubs define the two ends of the C-shaped slot. That is, these two metal stubs are located in the discontinuity area of the C-shaped slot. These two metal stubs (the C-shaped slot's discontinuity area) physically and electrically connect the inner radiating element to the outer radiating element.

Separate metal shorting posts are provided for each of the inner and outer radiating elements, to thereby connect both of these radiating elements to a metal ground plane element that is located under, and generally parallel to, a plane that contains the two radiating elements.

The non-radiating edge of the outer radiating element is electrically connected to a single feed post, and one of the two metal stubs that connect the outer radiating element to the inner radiating element is located relatively close to this feed post, to thus provide a virtual feed to the inner radiating element.

RF energy is fed to and taken from the two-PIFA assembly by way of this single feed post, wherein at least one of the two metal stubs acts as a virtual RF feed for the inner radiating element.

The outer radiating element, having the single RF feed post and a shorting post located on its non-radiating edge, acts as a first PIFA. The inner radiating element, the metal stub(s) that acts as a virtual RF feed thereto, and a second shorting post that is electrically connected to the ground plane element, acts as a second PIFA.

While two metal stubs are provided in embodiments of this invention, more generally a plurality of metal stubs connect the inner radiating element to the outer radiating element. With reference to the above-mentioned first PIFA and its outer radiating element, this plurality of metal stubs provide a matching and/or tuning function. With reference to above-mentioned second PIFA and its inner radiating element, this plurality of metal stubs provides both a virtual RF feed, and a matching/tuning function.

In addition, the present invention provides a generally L-shaped slot that is punched or cut into a metal sheet that contains the above mentioned C-shaped slot, inner radiating element and outer radiating element. This generally L-shaped slot has an open end that is located on the non-radiating edge of the outer radiating element, at a location that is between this element's feed post and shorting post. This generally L-shaped slot provides a wide bandwidth and the desired dual resonant frequencies. This L-shaped slot on the outer radiating element results in the effective quasi physical partitioning of the outer radiating element, resulting in the dual resonant characteristics of that PIFA.

As above-described, two spaced-apart metal stubs connect the outer radiating element to the inner radiating element, and these two spaced-apart metal stubs terminate the two ends of the above-described C-shaped slot. That is, the placement-choice of these two metal stubs results in two separate slot-discontinuities in what would otherwise be a continuous slot that separates the inner and outer radiating elements.

The first metal stub slot-discontinuity that interrupts such a visualized continuous slot is preferably placed in close proximity to the feed post that is located on the non-radiating edge of the outer radiating element. The second metal stub slot-discontinuity in such a visualized continuous slot is placed in close proximity to the closed end of the L-shaped slot.

A virtual RF feed post for the inner radiating element is provided by way of the first slot-discontinuity (i.e. by the first metal stub) in the C-shaped slot, and the second slot-discontinuity (i.e. the second metal stub) in the C-shaped slot functions as a matching and/or tuning element for the inner radiating element. Thus, the first metal stub can be considered to be a virtual feed post for the inner radiating element, and the second metal stub can be considered to be a tuning/matching element for the inner radiating element.

In addition, and in view of the direct physical connection of the first and second metal stubs to the outer radiating element, the first and second metal stubs can be considered to be matching/tuning elements for the outer radiating element.

A single-feed multi-band two-PIFA assembly utilizing the "PIFA within a PIFA" construction and arrangement of the present invention also provides additional resonance in the GPS frequency band. Thus, the single-feed multi-band "PIFA within a PIFA" of the present invention finds utility in systems that simultaneously require cellular and non-cellular resonance.

This single-feed multi-band "PIFA within a PIFA" of this invention, having response in both cellular and non-cellular resonant frequency bands, is achieved by providing a composite radiating element having a generally C-shaped slot therein that divides the composite radiating element into an inner radiating element and an outer radiating element, to thus provide a single-feed multi-band two-PIFA-assembly construction and arrangement for global cellular communications, including the AMPS/GSM/DCS/PCS frequency bands.

The construction and arrangement of this invention provides a "PIFA within a PIFA" wherein the radiating element of one PIFA is inserted into the radiating element of another PIFA. The quasi physical separation that exists between these two radiating elements provides for very nearly independent control of the multiple resonant frequency bands of the two individual PIFAs that are within the two-PIFA assembly.

The combination of, and the physical location of, the generally L-shaped slot and the generally C-shaped slot, along with the two metal stubs that connect these two slots, facilitates tuning the resonant frequencies of the two-PIFA assembly to the desired frequency bands.

The physical position of a single feed post, the size and position of a first shorting post for the outer radiating element, the size and position of the metal stub that acts as a virtual feed for the inner radiating element, the size and position of a second shorting post for the inner radiating element, as well as the size and position of the metal stub(s) that act as a matching/tuning element for the inner radiating element, the position and dimensions of the L-shaped slot on the outer radiating element, and the position and the dimensions of the C-shaped slot on the inner radiating element, provide an impedance match for the multi-band performance of the two-PIFA assembly, wherein multi-band impedance matching is achieved without the need for an external matching network.

Single-feed multi-band two-PIFA assemblies in accordance with the present invention provide resonant frequencies having utility in both cellular and non-cellular applications, wherein a single, unitary, two-PIFA assembly provides a "PIFA-within-a PIFA" construction and arrangement, and wherein it is relative ease to control the resonant characteristics of the two-antenna assembly so that the assembly in accordance with this invention exhibits resonance performance that is adequate for global cellular communication, including the AMPS/GSM/DCS/PCS frequency bands, without requiring a switch or an external matching network.

From the structural point of view, multi-band two-PIFA assemblies in accordance with the invention require only that an additional shorting post be provided for the inner radiating element, and the composite radiating element of the multi band two-PIFA assembly is amenable for large-scale manufacturing by punching/cutting, and then bending, a single piece of metal.

In accordance with a feature of this invention, a single metal sheet or plate is punched or cut in order to provided (1) a generally C-shaped slot that separates the metal sheet into an inner radiating element and an outer radiating element, (2) an L-shaped slot and a linear slot that are associated with the two radiating elements, (3) at least two metal stubs that interrupt the generally C-shaped slot and structurally support the inner radiating element in a cantilever fashion, (4) a metal shorting post for connecting the outer radiating element to a ground plane, (5) a metal feed post for transmitting RF energy to and from the outer radiating element, and (5) a plurality (for example three) metal plates that are connected to the edges of the outer radiating element.

Single-feed multi-band two-PIFA assemblies in accordance with the invention resonate in the AMPS/PCS frequency bands and the GSM/DCS frequency bands, as well as in the GPS frequency band, and they provide great potential for utility in global cellular handsets and in system applications that require simultaneous cellular and non-cellular operation.

Many original equipment manufacturers (OEMs) desire a cellular antenna, and more specifically an internal cellular antenna, that operates in both the US cellular (AMPS/PCS) and the European cellular (GSM/DCS) bands. The single-feed multi-band two-PIFA assembly of this invention, having four band (AMPS/GSM/DCS/PCS) performance, is an appropriate choice for these OEMs. In view of an additional resonance in the non-cellular (GPS) frequency band, the multi-band two-PIFA assemblies of this invention have additional utility in systems requiring simultaneous cellular and non-cellular operations.

DETAILED DESCRIPTION

Figure 1:
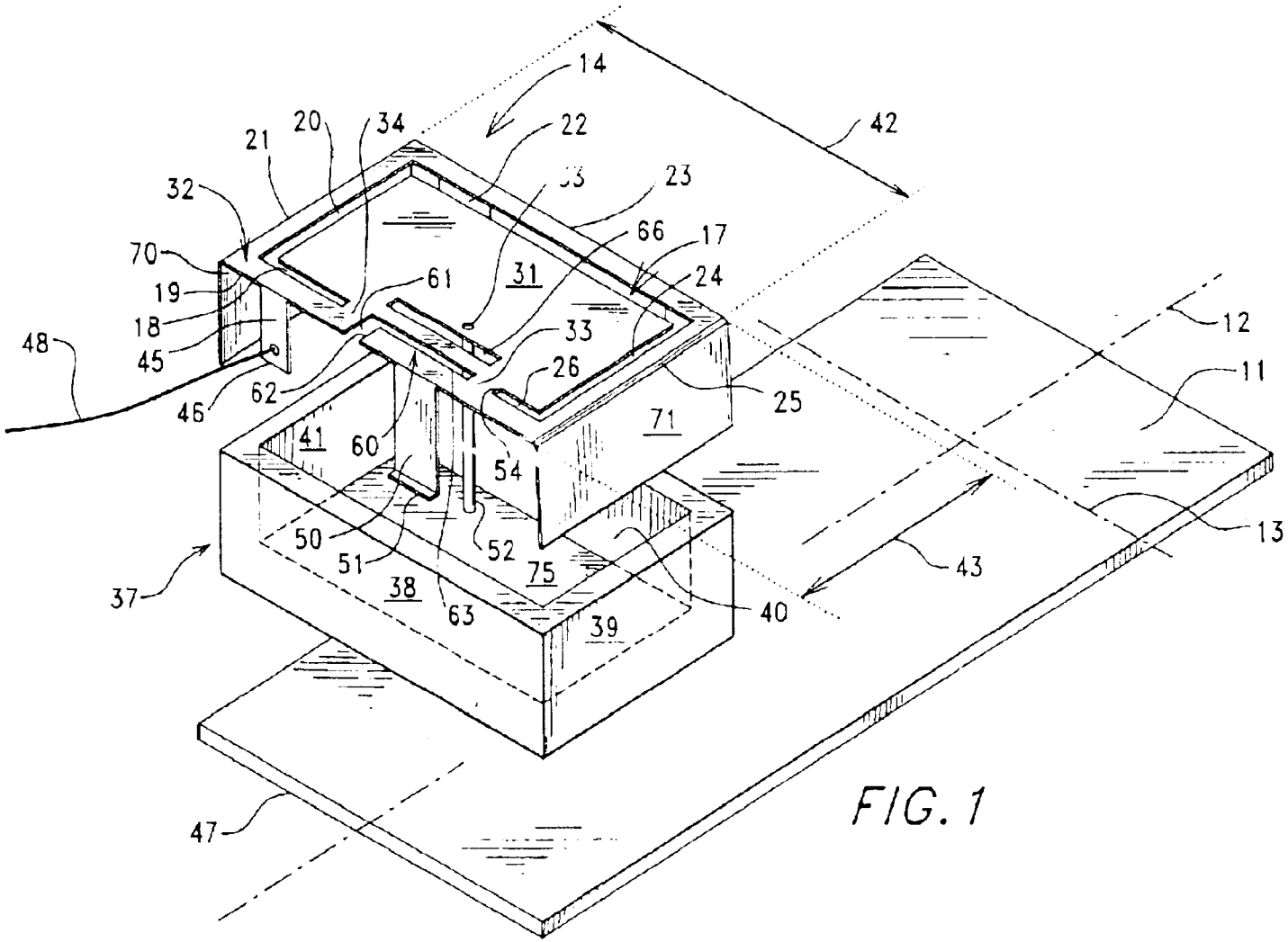
FIG. 1 is an exploded top and side perspective view of a two-PIFA assembly in accordance with the invention, this figure showing a metal sheet that contains a generally C-shaped slot that divides the metal sheet into an inner radiating element and an outer radiation element, this figure showing a four sidewall and box-like dielectric carriage whose sidewalls support the composite, inner/outer, radiating element above a metal ground plane element, this figure showing a metal feed post that extends downward from the non-radiating edge of the outer radiating element and along a sidewall of the dielectric carriage so that a free end of this metal feed post is physically spaced above the ground plane element, this figure showing a first metal shorting post that extends downward from the non-radiating edge of the outer radiating element and along the same sidewall of the dielectric carriage so that an end of this first metal shorting post is electrically connected to the ground plane element, and this figure showing a second metal shorting post that extends downward closely adjacent to the non-radiating edge of the inner radiating element so that an end of this second shorting post is electrically connected to the ground plane element.

FIG. 1 is an exploded top and side perspective view of a two-PIFA assembly 10 in accordance with the invention, i.e. a "PIFA-within-a PIFA" assembly 10 in accordance with the invention.

Two-PIFA assembly 10 includes a generally flat metal sheet 11 that functions as a common ground plane element of the two-PIFA assembly. Ground plane element 11 includes a major or long axis 12 and a minor or short axis 13 that extends perpendicular to major axis 12.

By way of a non-limiting example, in an embodiment of the invention the major length 12 of ground plane element 11 was about 4.33 inch, the minor width 13 of ground plane element 11 was about 1.65 inch, and the height of the assembled two-PIFA assembly 10 (i.e. the dimension measured perpendicular to the plane of ground plane-element 11) was about 0.394 inch.

Reference number 14 designates a composite metal radiating element that contains a C-shaped slot that divides composite radiating element 14 into an inner radiating element 31 and an outer radiation element 32 that generally surrounds inner radiating element 31. By way of example only, in an embodiment of the invention dimension 42 of composite radiating element 14 was about 1.54 inch and dimension 43 was about 0.95 inch.

Figure 3A:
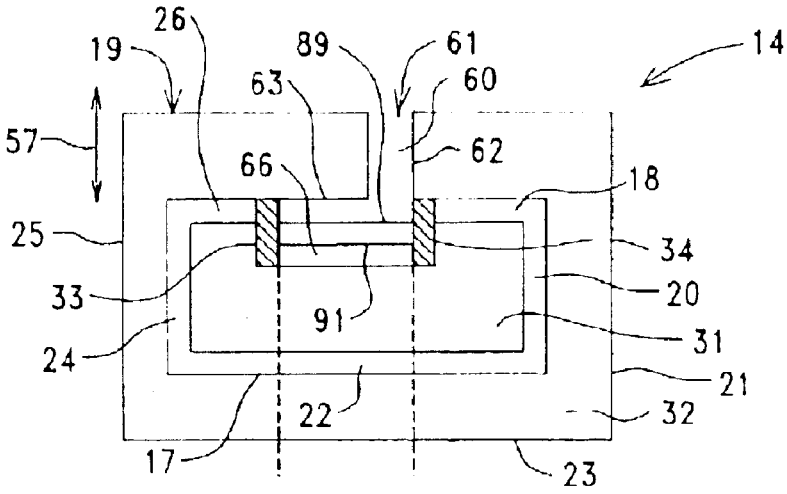
FIG. 3*a* is a top view the composite radiating element and three-slot arrangement of FIGS. 1 and 2, wherein a composite slot includes (1) a C-shaped slot, (2) an L-shaped slot having a slot-segment that appears to be a continuation of the C-shaped slot, and (3) a linear slot that is positionally displaced from, and parallel to, the above-mentioned slot segment of the C-shaped slot, this figure also showing the two metal stubs that extend between the inner and outer radiating elements.

Referring to FIG. 3*a* for example, composite radiating element 14 is made of a metal sheet that is punched or cut so as to form (1) a generally C-shaped open slot 17, (2) a generally L-shaped open slot 60, and (3) a generally linear open slot 66 therein.

This processing of the metal sheet provides a metal sheet that includes (1) metal inner radiating element 31, (2) metal outer radiating element 32 that generally surrounds inner radiating element 31 and that occupies generally the same plane as inner radiating element 31, and two metal stubs 33 and 34 that extend between inner radiating element 31 and outer radiating element 32 and that occupy generally the same plane as the two radiating elements.

Generally C-shaped slot 17 includes (1) a first slot segment 18 that extends generally parallel to the non-radiating edge 19 of composite radiating element 14 and generally parallel to the minor axis 13 of ground plane element 11, (2) a second slot segment 20 that extends generally parallel to the side edge 21 of composite radiating element 14 and generally parallel to the major axis 12 of ground plane element 11, (3) a third slot segment 22 that extends generally parallel to the minor axis 13 of ground plane element 11 and generally parallel to the radiating edge 23 of composite radiating element 14, (4) a fourth slot segment 24 that extends generally parallel to the major axis 12 of ground plane element 11 and generally parallel to the side edge 25 of composite radiating element 14, and (5) a fifth slot segment 26 that extends generally parallel to the minor axis 13 of ground plane element 11 and generally parallel to the non-radiating edge 19 of composite radiating element 14.

C-shaped slot 17 is interrupted by two metal stubs 33 and 34. Metal stubs 33 and 34 physically support inner radiating element 31. As will be apparent, at least metal stub 34 acts as a virtual RF feed for inner radiating element 31, at least metal stub 33 acts as a matching/tuning element for inner radiation element 31, and the two metal stubs 33 and 34 act as matching/tuning elements for outer radiating element 32.

Reference number 37 in FIG. 1 designates a box-like and rigid dielectric carriage having four sidewalls 38, 39, 40 and 41 that support composite, inner/outer, metal radiating element 14 above metal ground plane element 11. By way of a non-limiting example, dielectric carriage 37 may be made of High Density Poly Ethylene (HDPE), PolyCarbonate, or Acrolonitrite Butadiene Styrene (ABS).

In a non-limiting embodiment of the invention, the four sidewalls 38, 39, 40 and 41 of dielectric carriage 37 were of generally equal height (the dimension measured generally perpendicular to ground plane element 11) and were about 0.079 inch thick, they defined a generally rectangular cross-section open cavity 75 between composite radiating element 14 and ground plane element 11, the two opposite sidewalls 38 and 40 were of generally equal length and were parallel, the two opposite sidewalls 39 and 41 were of generally equal length and were parallel, and sidewalls 39 and 41 extended perpendicular to sidewalls 38 and 40.

Composite radiating element 14 (composed of inner radiating element 31 and outer radiating element 32) includes a single metal feed post 45 that is bent to extend generally 90-degrees downward from the top planar surface of composite radiating element 14. That is, metal feed post 45 extends downward from the non-radiating edge 19 of composite radiating element 14. In practice, metal feed post 45 lies closely adjacent to, or abuts against, the sidewall 38 of dielectric carriage 37.

When the two-PUFA assembly 10 of FIG. 1 is assembled, the end 46 of feed post 45 is spaced from the top and generally planar surface of ground plane element 11, at a location that is relatively close to the edge 47 of ground plane element 11. A coaxial feed cable, generally identified at 48, is connected to the end 46 of feed post 45 so as to provide a means whereby RF energy is received from and supplied to composite radiating element 14.

A first PIFA that includes outer radiating element 32 is provided with a first metal shorting post 50 that is bent so as to extend generally 90-degrees downward from the top planar surface of composite radiating element 14. That is, this first metal shorting post 50 extends downward from the non-radiating edge 19 of composite radiating element 14. In practice, metal shorting post 50 lies closely adjacent to, or abuts against, the sidewall 38 of dielectric carriage 37.

When the two-PIFA assembly 10 of FIG. 1 is assembled, the end 51 of this first shorting post 50 physically engages, and is electrically connected to, the top and generally planar surface of ground plane element 11 at a location that is relatively close to the edge 47 of ground plane element 11.

In the construction and arrangement of this first PIFA, metal-feed post 45 provides a means for supplying RF energy to outer radiating element 32, and for receiving RF energy from outer radiating element 32, as outer radiating element 32 cooperates with ground plane element 11, and as the non-radiating edge 19 of outer radiating element 32 is shorted to ground plane element 11 by the first shorting post 50.

The second PIFA of FIG. 1's two-PIFA assembly 10 includes inner radiating element 31. A second metal shorting post 52 extends generally 90-degress downward from the plane of inner radiating element 31, at a location that is closely adjacent to the non-radiating edge of inner radiating element 31, as this non-radiating edge is generally defined by the inner edges of the two slot segments 18 and 26.

When the two-PIFA assembly 10 of FIG. 1 is assembled, the top end of this second metal shorting post 52 is electrically connected to inner radiating element 31 at a location that is designated by number 53, and the bottom end of this second metal shorting post 52 is electrically connected to ground plane element 11 at a location that is spaced from, but is closely adjacent to, the edge 47 of ground plane element 11.

With reference to FIG. 1, the metal stub 34 that is located close to feed post 45 provides a virtual RF feed electrical connection to inner radiating element 31 whereby RF energy is supplied to inner radiating element 31 and RF energy is received from inner radiating element 31, as inner radiating element 31 cooperates with ground plane element 11, and as the non-radiating edge portion of inner radiating element 31 is shorted to ground plane element 11 by the second shorting post 52.

In the construction and arrangement of this second PIFA, virtual feed 34 provides a means for supplying RF energy to inner radiating element 31, and for receiving RF energy from inner radiating element 31, as inner radiating element 31 cooperates with ground plane element 11, and as the non-radiating portion of inner radiating element 31 is shorted to ground plane element 11 by the second shorting post 52.

Composite radiating element 14 also includes an L-shaped slot 60 having an open end 61 that is located on the non-radiating edge 19 of composite radiating element 14, at a location that is between feed post 45 and the first shorting post 50.

L-shaped slot 60 is made up two slot segments, i.e. a first slot segment 62 that extends generally perpendicular to non-radiating edge 19 and generally parallel to the major axis 12 of ground plane element 11, and a second slot segment 63 that extends generally parallel to non-radiating edge 19 and generally parallel to the minor axis 13 of ground plane element 11.

L-shaped slot 60 forms a quasi physical partitioning of a single band PIFA structure, wherein the term single band PIFA structure implies that composite radiating element 14 is devoid of any slot, and that its resonant frequency is primarily dependent upon the semi perimeter of composite radiating element 14 as well as on the separation distance between composite radiating element 14 and ground plane 11.

The quasi physical partitioning that is realized by providing L-shaped slot 60 within composite radiating element 14 transforms such a single band PIFA structure into the multi-band PIFA whose resonant frequencies are dependent not only on the linear dimensions of the PIFA, but also on the size of L-shaped slot 60, with the resonant frequencies also being influenced by the physical locations of first shorting post 50 and feed post 45.

In general, the slots within composite radiating element 14 (straight/linear or L-shaped) serve the dual purpose of imparting quasi physical partitioning, as well as imparting reactive loading to the PIFA structure. Reactive loading lowers the resonant frequency of such a PIFA, without increasing its physical size. Slot length is a significant parameter that determines the realizable reactive loading.

In the single-feed multi-band PIFA 10 wherein both feed post 45 and the first shorting post 50 are aligned along a line that is parallel to the minor axis 13 of ground plane 11, it is generally observed that a straight slot having its axis parallel to the major axis 12 of ground plane 11, and having its open end on non-radiating edge 19, may not realize a desired resonance in the cellular bands (AMPS/GSM) when there is a constraint on the allowable length (i.e. the linear dimension parallel to the major axis 12 of ground plane 11). This constraint on the length of PIFA 10 would limit the maximum permissible length of a straight/linear slot.

To overcome this limitation, L-shaped slot 60 is preferred, L-shaped slot 60 having a vertical segment 62 that is parallel to the major axis 12 of ground plane 11, and having a horizontal segment 63 that is parallel to the minor axis 13 of ground plane 11.

The combined length of L-shaped slot 60 enhances the realizable reactive loading even when there is a constraint on the linear dimension of PIFA 10. When the open end 61 of L-shaped slot 60 is located between feed post 45 and the first shorting post 50 of PIFA 10, an additional advantage is provided in that the bandwidth centered around both the lower and upper resonant frequencies is increased.

Composite radiating element 14 also includes a generally linear slot 66 that is closely spaced inward from slot segment 63, so as to generally lie within inner radiating element 31. In this non-limiting embodiment of the invention linear slot 66 had a length that was generally equal to slot segment 63, and linear slot 66 extended generally parallel to slot segment 63.

Linear slot 66 lies in a common region of what can be called a slot-discontinuity within C-shaped slot 17, this slot-discontinuity being shared by the two metal stubs 33 and 34, and with one edge of linear slot 66 lying adjacent to the second shorting post 52 of inner radiating element 31. Linear slot 66 is also a means of ensuring a physical separation between the two metal stubs 33 and 34.

When the first metal stub 34 is considered to be a virtual feed for inner radiating element 31, the second metal stub 33 acts as a tuning element for inner radiating element 31. It is also possible to visualize that linear slot 66 enables inner radiating element 31 to have two feeds 33 and 34 which lie on two opposite sides of the shorting post 52 for inner radiating element 31.

Linear slot 66, being common to both outer radiating element 32 and inner radiating element 31, can also be equivalently termed as a closed coupling slot 66. The size and the position of linear slot 66 is an additional parameter to optimize the influence of the close proximity of inner radiating element 31 to complement the resonance characteristics of outer radiating element 32, and vice versa.

With reference to the two metal stubs 33 and 34, one can treat one of these two metal stubs as a matching stub for inner radiating element 31, whereupon the other metal stub can be considered to be a virtual feed for inner radiating element 31. In addition, the two metal stubs 33 and 34 can be visualized as two virtual feeds to inner radiating element 31, with shorting post 52 being located between the two metal stubs 33 and 34. However, both of the metal stubs 33 and 34 comprise matching or tuning stubs for outer radiating element 32.

As a feature of the invention, composite radiating element 14 of two-PIFA assembly 10 in accordance with the invention includes a number of reactive (capacitive) metal tuning plates or stubs that extend downward from the top surface of composite radiating element 14 to locations that are closely adjacent to, but spaced from, the top surface of ground plane element 11.

Figure 2:
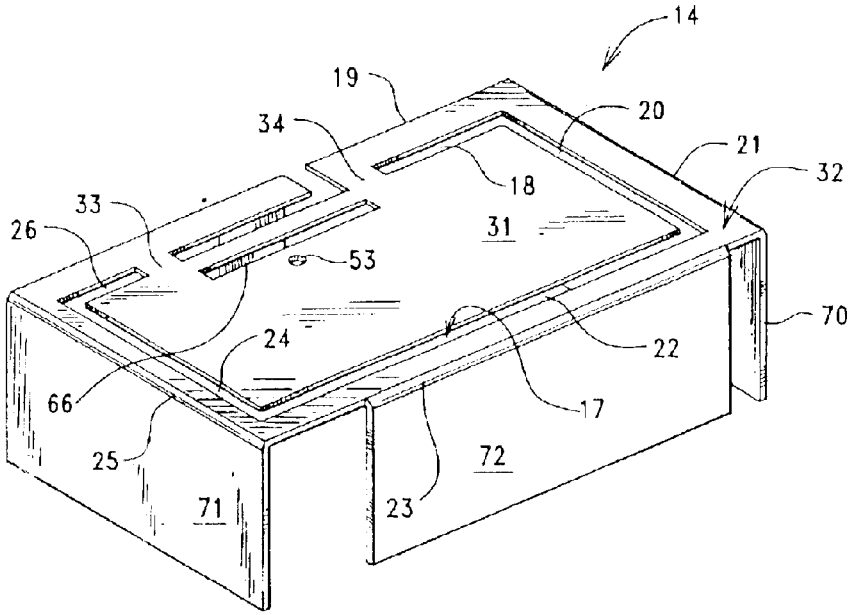
FIG. 2 is a perspective view of the composite radiating element of FIG. 1, this figure better showing the radiating edge of the outer radiating element and the radiating edge of the inner radiating element.

More specifically, and with reference to FIGS. 1 and 2, composite radiating element 14 includes a first metal plate 70 that is bent downward about 90-degrees from the side edge 21 of composite radiating element 14, and a second metal plate 71 that is bent downward about 90-degrees from the side edge 25 of composite radiating element 14.

When the two-PIFA assembly 10 is assembled, metal plate 71 lies closely adjacent to, or abuts against, the sidewall 39 of dielectric carriage 37, and metal plate 70 lies closely adjacent to, or abuts against, the opposite sidewall 41 of dielectric carriage 37.

In addition, and with reference to FIG. 2, composite radiating element 14 includes a third metal plate 72 that is bent downward about 90-degrees from the radiating edge 23 of composite radiating element 14. When two-PIFA assembly 10 is assembled, metal plate 72 lies closely adjacent to, or abuts against, the sidewall 40 of dielectric carriage 37.

Metal plate 70 acts as a capacitive loading plate for composite radiating element 14, and it controls the resonant characteristics of the upper resonant band without affecting the response of the lower band. Metal plate 71 is another means of providing capacitive loading of composite radiating element 14. Metal plate 71 primarily controls the resonant characteristics of the lower resonant band, and it exhibits minor effects on the response of the upper resonant band. Metal plate 72 functions as a capacitive loading element for composite radiating element 14 that controls the resonance characteristics of both the lower and the upper resonant bands.

FIG. 3*a* is another showing of the three above-described slots that are formed in composite radiating element 14, i.e. C-shaped slot 17, L-shaped slot 60, and linear slot 66.

Conceptually, FIG. 3*a* shows a composite-slot that is formed by a combination of C-shaped slot 17 (see FIG. 3*c*) and the slot segment 63 of L-shaped slot 60 (see FIG. 3*b*) that extends parallel to the minor axis 13 of ground plane 11 (see FIG. 1), wherein the three slot segments 26, 63 and 18 are generally aligned and extend parallel to the major axis 12 of ground plane 11. These three slot segments are located a distance 57 of about 0.119 inch from the non-radiating edge 19 of composite radiating element 14.

Figure 3B:
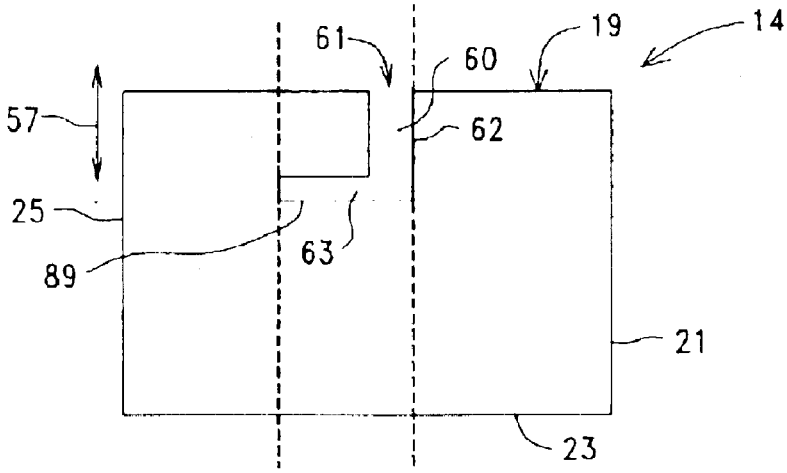
FIG. 3*b* shows only the L-shaped slot of FIG. 3*a*, with the open end of the L-shaped slot being located on the non-radiating edge of the outer radiating element.
Figure 3C:
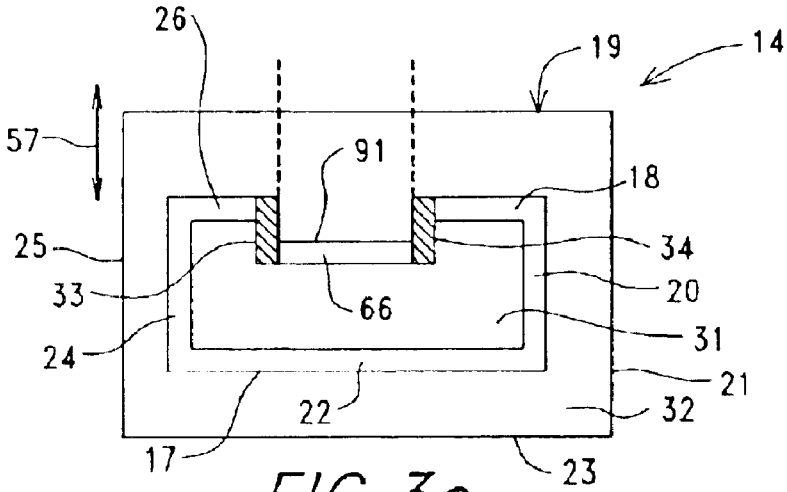
FIG. 3*c* shows a combination of the C-shaped slot, the linear slot of FIG. 3*a*, and the two spaced-apart metal stubs that extend between the inner and outer radiating elements.

As illustrated in FIG. 3*c*, the two metal stubs 33 and 34 are spaced apart and they transform what would have been a continuous-slot into the discontinuous C-shaped slot 17.

Linear slot 66 lies between the two metal stubs 33 and 34, and linear slot 66 appears to be a displaced-portion of such a continuous-slot.

As shown in FIG. 3*b*, the length of slot segment 62 of L-shaped slot 60 is chosen such that the edge 89 of slot segment 63 is at a pre-determined distance from the radiating edge 91 (see FIG. 3*c*) of linear slot 66.

Alignment of the two metal stubs 33 and 34, visa vis segment 63 of L-shaped slot 60, allow linear slot 66 to be of a length equal to that of segment 63 of L-shaped slot 60. This results in the location of linear slot 66 in the close vicinity of an active L-shaped slot 60, wherein the term active implies that L-shaped slot 60 has an open end 61 along an edge of composite radiating element 14.

In general, L-shaped slot 60, whose open end 61 lies on the edge 19 of composite radiating element 14 that contains FIG. 1's feed post 45 and shorting post 50, provides a more rapid response than a slot that does not have an open end, or whose open end is along an axis that is perpendicular to an edge that contains the PIFA's feed and shorting posts.

In summary, the "PIFA within a PIFA", virtual two-PIFA assembly of this invention, having response in both cellular and non-cellular resonant frequency bands, is achieved by providing a composite radiating element having a composite slot that defines an inner radiating element and-an outer radiating element within the composite radiating element, having one physical RF feed post that is connected to the outer radiating element, having a virtual feed that connects the one physical feed post to the inner radiating element, having a first shorting post that connects the outer radiating element to a ground plane element, and having a second shorting post that connects the inner radiating element to the ground plane element.

The invention provides a single-feed multi-band virtual two-PIFA-assembly that is constructed and arranged for global cellular communications, including the AMPS/GSM/DCS/PCS frequency bands. The two-PIFA construction and arrangement of this invention provides a "PIFA within a PIFA" wherein the radiating element of one PIFA is inserted into the radiating element of another PIFA, wherein the physical separation between the two PIFA radiating elements provide for very nearly independent control of the multiple resonant frequency bands of the two individual PIFAs that are within two-PIFA assembly.

The combination of, and the physical location of, a generally L-shaped slot and a generally C-shaped slot, along with two metal stubs that connect the two slots, facilitates tuning the resonant frequencies of the two PIFAs to desired frequency bands.

The physical position of the single feed post, the size and position of first shorting post for the outer radiating element, the size and position of the metal stub that acts as a tuning element for the inner radiating element, the position and dimensions of the L-shaped slot on the outer radiating element, the position and dimensions of the C-shaped slot on the inner radiating element, the virtual feed for the inner radiating element, as well as the position and the size of the shorting post for the inner radiating element, provide an impedance match for the multi band performance of the two-PIFA assembly wherein multi band impedance matching is achieved without the need for an external matching network.

Single-feed multi-band two-PIFA assemblies in accordance with the present invention provide multiple resonant frequencies having utility in both cellular and non-cellular applications, wherein a single, unitary, two-PIFA assembly provides a "PIFA-within-a PIFA" construction and arrangement, and wherein it is relative ease to control the resonant characteristics of the two-antenna assembly so that the two-antenna assembly in accordance with this invention exhibits resonance performance that is adequate for global cellular communication, including the AMPS/GSM/DCS/PCS frequency bands, without requiring a switch or an external matching network.

From the structural point of view, a multi-band two-PIFA assembly in accordance with the invention requires only the addition of one element, i.e. the above-described second shorting post for the inner radiating element, and the composite radiating element that is within the multi-band two-PIFA assembly is amenable to large-scale manufacturing simply by punching or cutting, and then bending, a single piece of metal to form the various above-described slots that are formed within the composite radiating element, and the above-described feed post, shorting post and metal plates that protrude from the composite radiating element.

Single-feed multi-band two-PIFA assemblies in accordance with the invention resonate in the AMPS/PCS frequency bands and the GSM/DCS frequency bands, as well as in the GPS frequency band, and they have utility for use in global cellular handsets and in system applications that require simultaneous cellular and non-cellular operation.

While the invention has been described in detail while making reference to an embodiment thereof, it is known that others skilled in the art will, upon learning of this invention, readily visualize yet other embodiments that are within the spirit and scope of this invention. Thus, this detailed description is not to be taken as a limitation on the spirit and scope of this invention.

What is claimed is:

1. A method of providing an antenna assembly, comprising the steps of:

providing a metal ground plane element;

providing a metal plate;

forming a slot in said metal plate in a manner to produce an outer metal radiating element and an inner metal radiating element that is connected to said outer metal radiating element by at least one metal stub;

supporting said metal plate above said metal ground plane element;

providing a metal feed post extending from a portion of said outer metal radiating element;

connecting a feed cable to said metal feed post;

providing a first metal shorting post extending from said portion of said outer metal radiating element and connected to said metal ground plane element;

said first metal shorting post being spaced from said metal feed post; and providing a second metal shorting post extending from said inner metal radiating element and connected to said metal ground plane element.

2. The method of claim 1 wherein said metal ground plane element and said metal plate are generally parallel.

3. The method of claim 2 wherein said metal ground plane element has a larger planar area than said metal plate, and wherein an entire area of said metal plate is located over said metal ground plane element.

4. The method of claim 3 wherein said metal feed post is associated with said at least one metal stub such that said at least one metal stub functions as an virtual metal feed post for said inner metal radiating element.

5. The method of claim 4 wherein said at least one metal stub additionally functions as a matching/tuning element for said outer radiating element.

6. The method of claim 5 wherein said slot is a discontinuous slot, wherein a first metal stub forms a first end of said discontinuous slot that is relatively close to said metal feed post, and wherein a second metal stub forms a second end of said discontinuous slot that is relatively close to said first metal shorting post.

7. The method of claim 6 wherein said first metal stub functions as a virtual feed for said inner radiating element, wherein said second metal stub functions as a matching/tuning element for said inner radiating element, and wherein said first and second metal stubs function as matching/tuning elements for said outer radiating element.

8. The method of claim 6 wherein said outer metal radiating element and said inner metal radiating element lie in a common plane that is parallel to a plane of said metal ground plane element.

9. The method of claim 8 wherein said first and second metal stubs cantilever-support said inner metal radiating element.

10. The method of claim 9 including the step of:

providing a generally rigid dielectric carriage having a plurality of sidewalls whose top edges define a top surface that engages said metal plate, and whose a bottom edges define a bottom surface that engages said metal ground plane element.

11. The method of claim 10 wherein said antenna assembly contains a first planar inverted-F antenna including said outer metal radiating element, and a second planar inverted-F antenna including said inner metal radiating element.

12. The method of claim 10 including the step of:

providing a generally L-shaped slot between said first and second metal stubs;

said generally L-shaped slot having an open end located between said first metal shorting post and said metal feed post.

13. The method of claim 12 including the step of:

providing at least one metal plate extending from said outer metal radiating element toward said metal ground plane element;

said at least one metal plate having an end that is spaced above said metal ground plane element.

14. The method of claim 13 wherein said at least one metal plate closely abuts at least one sidewall of said dielectric carriage to comprise at least one reactive loading plate for said antenna assembly.

15. The method of claim 14 including the step of:

providing a further slot in said inner metal radiating element at a location generally intermediate said first and second metal stubs.

16. The method of claim 15 wherein said antenna assembly contains a first planar inverted-F antenna including said outer metal radiating element, and a second planar inverted-F antenna including said inner metal radiating element.

17. The method of claim 16 wherein said first metal stub functions as a virtual feed for said inner radiating element, wherein said second metal stub functions as a matching/tuning element for said inner radiating element, and wherein said first and second metal stubs function as matching/tuning elements for said outer radiating element.

18. A method of providing a unitary PIFA-within-a-PIFA assembly, comprising the steps of:

providing a planar ground plane element;

providing a planar composite radiating element;

forming a generally C-shaped slot within said composite radiating element to produce an inner radiating element and an outer radiating element that generally surrounds said inner radiating element and is coplanar with said inner radiating element;

said generally C-shaped slot having a metal slot-discontinuity that connects said inner radiating element to said outer radiating element;

providing a generally rigid dielectric carriage for supporting said composite radiating element generally parallel to said ground plane element;

providing a feed post extending from an edge-portion of said outer radiating element;

providing a first shorting post extending from said edge-portion of said outer radiating element and connected to said ground plane element;

said first shorting post being spaced from said feed post; and providing a second shorting post extending from said inner radiating element and connected to said ground plane element.

19. The method of claim 18 wherein said metal slot-discontinuity is located adjacent to said edge-portion of said outer radiating element.

20. The method of claim 19 including the step of:

providing a generally L-shaped slot generally within said metal slot-discontinuity;

said generally L-shaped slot forming two metal stubs within said slot-discontinuity that connect said inner radiating element to said outer radiating element;

said generally L-shaped slot having an open end located on said edge-portion of said outer radiating element between said feed post and said first shorting post.

21. The method of claim 20 including the steps of:

providing that a first of said two metal stubs is constructed and arranged to form a virtual feed for said inner radiating element;

providing that a second of said two metal stubs is constructed and arranged to form a matching/tuning element for said inner radiating element; and providing that said first and second metal stubs are constructed and arranged to form matching/tuning elements for said outer radiating element.

22. The method of claim 20 including the step of:

providing at least one metal plate extending from said outer radiating element toward said ground plane element;

said at least one metal plate having an end that is spaced from said ground plane element; and said at least one metal plate being closely associated with said dielectric carriage and comprising at least one reactive loading plate.

23. The method of claim 22 including the step of:

providing a generally linear slot in said composite radiating element within said inner radiating element and generally intermediate said first and second metal stubs.

24. The method of claim 23 wherein said composite radiating element is formed by the steps of:

providing a generally flat metal plate that occupies a plane;

processing said flat metal plate to form said generally C-shaped slot, said first and second metal stubs and said generally L-shaped slot therein, to form said generally linear slot therein, to form said feed post therein, to form said first shorting post therein, and to form said at least one plate therein; and bending said feed post, said first shorting post and said at least one metal plate in a common direction relative to said plane.

25. The method of claim 24 wherein said feed post, said first shorting post and said at least one plate are bent about 90-degrees relative to said plane.

26. The method of claim 25 including the step of:

constructing and arranging said unitary PIFA-within-a-PIFA assembly for resonance in the AMPS, the PCS, the GSM and the DCS frequency bands.

27. The method of claim 26 including the step of:

additionally constructing and arranging said unitary PIFA-within-a-PIFA mechanical assembly for resonance in the GPS frequency band.

28. A unitary two-antenna assembly having a single feed port and providing multiple frequency response, comprising:

a metal ground plane element;

a metal sheet physically that is spaced from and generally parallel to said metal ground plane element;

a generally C-shaped slot formed in said metal sheet forming in said metal sheet into an inner radiating element, an outer radiating element, and a metal stub connecting said inner radiating element to said outer radiating element;

said metal stub forming a discontinuity in said generally C-shaped slot;

a metal feed post extending from a first portion of said outer radiating element;

a first metal shorting post extending from said first portion of said outer radiating element having an end connected to said ground plane element;

said first metal shorting post being spaced from said metal feed post; and a second metal shorting post extending from a portion of said inner radiating element that is generally adjacent to said metal stub having an end connected to said ground plane element.

29. The unitary two-antenna assembly of claim 28 including:

a plurality of metal plates extending from portions of said outer radiating element, each of said metal plates having an end spaced from said ground plane element.

30. The unitary two-antenna assembly of claim 29 wherein said metal feed post, said first metal shorting post, and said plurality of metal plates are integral parts of said metal sheet.

31. The unitary two-antenna assembly of claim 30 wherein said second metal shorting post is a disjoint metal post having one end secured to said inner radiating element and having an opposite end secured to said ground plane element.

32. The unitary two-antenna assembly of claim 28 including:

a generally L-shaped open slot formed in said metal sheet, said generally L-shaped open slot having an open end located on said first portion of said outer radiating element and between said first metal shorting post and said metal feed post.

33. The unitary two-antenna assembly of claim 32 including:

a dielectric carriage having a top surface cooperating with said inner and outer radiating elements, having a bottom surface cooperating with said ground plane element, and having a first sidewall cooperating with said metal feed post and said first metal shorting post.

34. The unitary two-antenna assembly of claim 33 including:

a plurality of metal plates extending from of said outer radiating element, in a direction toward said ground plane element, each of said metal plates having an end that is spaced from said ground plane element, said plurality of metal plates cooperating with other sidewalls of said dielectric carriage so as to form a plurality of reactive plates for said two-antenna assembly.

35. The unitary two-antenna assembly of claim 28 including:

a slot formed in said metal stub operating to divide said metal stub into two physically spaced metal stubs that connect said inner radiating element to said outer radiating element;

at least one of said two metal stubs providing a virtual feed to said inner radiating element; and said two metal stubs providing a matching/tuning function for said outer radiating element.

36. The unitary two-antenna assembly of claim 35 wherein a first of said two metal stubs provides said virtual feed to said inner radiation element, and wherein a second of said two metal stubs provides a matching/tuning function for said inner radiating element.

37. A unitary PIFA-within-a-PIFA assembly having a single feed port and providing response to a plurality of frequency bands, comprising:

a dielectric carriage having four sidewalls that define a rectangular bottom surface having four orthogonal edges and a rectangular top surface having four orthogonal edges, said bottom surface being generally parallel to said top surface, and said four sidewalls extending generally perpendicular between said four orthogonal edges of said top surface and said bottom surface;

a rectangular metal ground plane element having four orthogonal edges;

said ground plane element having a top surface, a short axis, and a long axis that extends perpendicular to said short axis;

said ground plane element engaging said bottom surface of said dielectric carriage with a first sidewall of said dielectric carriage generally coincident with a first edge of said ground plane element that extends generally parallel to said short axis of said ground plane element, and with a second and a third sidewall said dielectric carriage generally coincident with opposite edges of said ground plane element that extend generally parallel to said long axis of said ground plane element;

a rectangular metal composite radiating element of generally the same size as said top surface of said dielectric carriage;

said composite radiating element having a non-radiating edge, a radiating edge that extends generally parallel to said non-radiating edge, and having a first and a second parallel side edge that extends generally perpendicular to said non-radiating edge and said radiating edge;

said composite radiating element engaging said top surface of said dielectric carriage with said radiating edge of said composite radiating element generally coincident with said first edge of said ground plane element, and with said first and second side edges of said composite radiating element generally coincident with said opposite edges of said ground plane element;

a metal feed post extending from said non-radiating edge of said composite radiating element;

a first metal shorting post extending from said non-radiating edge of said composite radiating element and spaced from said feed post;

said first shorting post extending in a direction toward said ground plane element and having an end thereof connected to said ground plane element;

a generally C-shaped slot in said radiating element;

said generally C-shaped slot having a first slot-segment that lies adjacent to said non-radiating edge of said composite radiating element, said first slot-segment having a closed end;

said generally C-shaped slot having a second slot-segment extending from said first slot-segment and lying adjacent to a first side edge of said composite radiating element;

said generally C-shaped slot having a third slot-segment extending from said second slot-segment and lying adjacent to said radiating edge of said composite radiating element;

said generally C-shaped slot having a fourth slot-segment extending from said third slot-segment and lying adjacent to an opposite side edge of said composite radiating element;

said generally C-shaped slot having a fifth slot-segment extending from said fourth slot-segment and lying adjacent to a non-radiating edge of said composite radiating element, and in alignment with said first slot-segment;

said fifth slot-segment having a closed end that is spaced from said closed end of said first slot-segment to define a discontinuity-area in said generally C-shaped slot;

a second shorting post extending from a portion of said composite radiating element that is on a side of said discontinuity-area opposite said non-radiating edge of said composite radiating element;

said second metal shorting post extending in a direction toward said ground plane element; and said second shorting post having an end thereof connected to said ground plane element.

38. The unitary PIFA-within-a-PIFA assembly of claim 37 including:

an generally L-shaped slot in said discontinuity-area, said generally L-shaped slot having an open end that is located on said non-radiating edge between said shorting post and said first feed post, having a first slot-segment that extends generally perpendicular to said non-radiating edge, and having a second slot-segment that extends from said first slot-segment and generally parallel to said non-radiating edge.

39. The unitary PIFA-within-a-PIFA assembly of claim of claim 38 including:

a generally linear slot in said discontinuity-area adjacent to said second slot-segment of said generally L-shaped slot and extending generally parallel to said non-radiating edge.

40. The unitary PIFA-within-a-PIFA assembly of claim 39 including:

a first metal plate extending from said first side of said composite radiating element in a direction toward said ground plane element, said first metal plate having an end spaced from said ground plane element, and said first metal plate cooperating with a sidewall of said dielectric carriage.

41. The unitary PIFA-within-a-PIFA assembly of claim 40 including:

a second metal plate extending from said opposite side of said composite radiating element in a direction toward said ground plane element, said second metal plate having an end spaced from said ground plane element, and said second metal plate cooperating with a sidewall of said dielectric carriage.

42. The unitary PIFA-within-a-PIFA assembly of claim 41 including:

a third metal plate extending from said radiating edge of said composite radiating element, in a direction toward said ground plane element, said third metal plate having an end spaced from said ground plane element, and said third metal plate cooperating with a sidewall of said dielectric carriage.

43. The unitary PIFA-within-a-PIFA assembly of claim 42 wherein said feed post, said first shorting post, and said first, second and third plates are integral parts of said composite radiating element, and wherein said second shorting post is a disjoint member having one end secured to said composite radiating element and having an opposite end secured to said ground plane element.

44. The unitary PIFA-within-a-PIFA assembly of claim 37 wherein said generally C-shaped slot divides said composite radiating element into an inner radiating element and an outer radiating element that surrounds said inner radiating element, including:

a slot in said discontinuity-area operating to form said discontinuity area into two spaced stubs that physically connect said inner radiating element to said outer radiating element;

a first of said stubs providing a virtual feed for said inner radiating element;

a second of said stubs providing a matching/tuning function for said inner radiating element; and said first and second stubs providing a matching/tuning function for said outer radiating element.

45. A unitary assembly providing two PIFAs within a physical volume usually occupied by one PIFA, comprising:

a metal radiating element supported above a metal ground plane element;

a generally C-shaped slot in said radiating element dividing said radiating element into an outer metal radiating element and an inner metal radiating element;

said generally C-shaped slot establishing a metal slot-discontinuity-area within said radiating element that physically and electrically connect said outer radiating element to said inner radiating element;

a metal feed post connected to said outer radiating element;

a first metal shorting post connecting said outer radiating element to said ground plane element; and a second metal shorting post connecting said inner radiating element to said ground plane element.

46. The unitary mechanical assembly of claim 45 including:

a generally L-shaped slot located generally in said slot-discontinuity-area operating to divide said slot-discontinuity-area into two spaced metal stubs that physically and electrically connect said outer radiating element to said inner radiating element.

47. The unitary mechanical assembly of claim 46 including:

a generally linear slot located generally in said slot-discontinuity-area.

48. The unitary mechanical assembly of claim 47 including:

at least one metal plate extending from said radiating element toward said ground plane element, but out of physical contact with said ground plane element.

49. The unitary assembly of claim 48 wherein a first of said two metal stubs provides a virtual feed to said inner radiating element, wherein a second of said two metal stubs provides a matching and/or tuning function for said inner radiating element, and wherein said two metal stubs provide a matching and/or tuning function for said outer radiating element.

50. The unitary assembly of claim 45 including:

a slot located generally in said slot-discontinuity-area operating to divide said slot-discontinuity-area into two spaced metal stubs that physically and electrically connect said outer radiating element to said inner radiating element;

at least one of said two metal stubs provide virtual feed to said inner radiating element; and said two metal stubs provide a matching/tuning function to said outer radiating element.

* * * * *